US005971599A

United States Patent [19]

Bothers

[11] Patent Number: 5,971,599

[45] Date of Patent: Oct. 26, 1999

[54] RECIPROCATING SHAKER APPARATUS

[76] Inventor: Ron Scott Bothers, 66 Wertsville Rd., Ringoes, N.J. 08551

[21] Appl. No.: 09/034,991

[22] Filed: Mar. 5, 1998

[51] Int. Cl.[6] ..... B01F 11/00

[52] U.S. Cl. ..... 366/142; 366/212; 366/110

[58] Field of Search ..... 366/110–112, 114, 366/142, 208–212, 219, 602

[56] References Cited

U.S. PATENT DOCUMENTS

| | | | |
|---|---|---|---|
| D. 340,249 | 10/1993 | Steele . | |
| 1,908,104 | 5/1933 | Bell | 366/111 |
| 2,034,902 | 3/1936 | Heinze | 366/209 |
| 2,082,593 | 6/1937 | Pankotan | 366/212 |
| 2,597,536 | 5/1952 | Shields | 366/211 |
| 3,045,987 | 7/1962 | Cake | 366/110 |
| 3,128,082 | 4/1964 | Cline | 366/210 |
| 3,331,588 | 7/1967 | Nasser | 366/211 |
| 3,503,592 | 3/1970 | Taylor, Sr. et al. | 366/212 |
| 4,173,418 | 11/1979 | Vork | 366/110 |
| 4,316,672 | 2/1982 | Kerscher | 366/110 |
| 4,422,768 | 12/1983 | Solomon | 366/110 |
| 4,893,938 | 1/1990 | Anderson | 366/208 |
| 5,273,357 | 12/1993 | Currie | 366/212 |
| 5,399,013 | 3/1995 | Sawyer | 366/211 |

*Primary Examiner*—Charles E. Cooley

[57] ABSTRACT

A shaker apparatus including a base member that has a front side and a top portion. A bottle holder is provided and has a flat member. The flat member has an interior side with a pair of end plates projecting outwardly. A rocker arm extends from an exterior side of the flat member and is symmetrically spaced from the pair of end plates. A generally cylindrical housing member is included and has a first end mounted to the top side of the base member, a second end edge and an inner support plate. The housing member having a battery compartment. Lastly, a vibrator is seated on the inner support plate of the housing member. The vibrator has an upper side with a pair of support brackets. The support brackets are coupled with the rocker arm of the bottle holder to support the bottle holder above the base member.

7 Claims, 2 Drawing Sheets

RECIPROCATING SHAKER APPARATUS

BACKGROUND OF THE INVENTION

1. Field of the Invention

The present invention relates to a shaker apparatus and more particularly pertains to providing an apparatus for agitating a bottle of liquid paper and further usable for shaking a bottle of nail polish.

2. Description of the Prior Art

The use of a bottle shaker is known in the prior art. More specifically, bottle shakers heretofore devised and utilized for the purpose of agitating the liquid within the bottle are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,273,357 to Currie discloses a nail polish shaker apparatus. U.S. Pat. No. 5,399,013 to Sawyer discloses a mixing device. U.S. Pat. Des. 340,249 to Steele discloses an automatic capsule mixing device. U.S. Pat. No. 4,893,938 to Anderson discloses a container shaking device. U.S. Pat. No. 4,316,672 to Kerscher discloses a shaking machine, especially for an indian ink writing device. Lastly, U.S. Pat. No. 4,173,418 to Vork discloses an apparatus for mixing liquids.

In this respect, the shaker apparatus according to the present invention substantially departs from the conventional concepts and designs of the prior art, and in so doing provides an apparatus primarily developed for the purpose of providing an apparatus for agitating a bottle of liquid paper and further usable for shaking a bottle of nail polish.

Therefore, it can be appreciated that there exists a continuing need for a new and improved shaker apparatus which can be used for providing an apparatus for agitating a bottle of liquid paper and further usable for shaking a bottle of nail polish. In this regard, the present invention substantially fulfills this need.

SUMMARY OF THE INVENTION

In view of the foregoing disadvantages inherent in the known types of bottle shakers now present in the prior art, the present invention provides an improved shaker apparatus. As such, the general purpose of the present invention, which will be described subsequently in greater detail, is to provide a new and improved Shaker apparatus which has all the advantages of the prior art and none of the disadvantages.

To attain this, the present invention essentially comprises a generally rectangular base member. The base member has a front side and a top portion. The base member has a digital time keeping device therein. A face of the digital time keeping device is displayed on the front side of the base member.

Included is a bottle holder that has a flat member. The flat member has an interior side with a pair of end plates projecting outwardly. The pair of end plates form a first end plate and a second end plate. The first end plate has an elongated opening therethrough. The second end plate has an interior face with a tension spring mounted thereon. A rocker arm extends from an exterior side of the flat member and is symmetrically spaced from the pair of end plates.

Also, a generally cylindrical housing member is provided. The cylindrical housing member has a first end mounted to the top side of the base member, a second end edge and an inner support plate. A battery compartment is contained within the housing member. Lastly, a vibrator is seated on the inner support plate of the housing member. The vibrator has an upper side with a pair of support brackets. The support brackets are coupled with the rocker arm of the bottle holder to support the bottle holder above the base member. The vibrator is in electrical communication with the battery compartment. The vibrator moves the rocker arm for shaking a bottle within the bottle holder when activated by a switch positioned on the top side of the base member.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved shaker apparatus which has all the advantages of the prior art bottle shakers and none of the disadvantages It is another object of the present invention to provide a new and improved shaker apparatus which may be easily and efficiently manufactured and marketed.

It is a further object of the present invention to provide a new and improved shaker apparatus which is of a durable and reliable construction.

An even further object of the present invention is to provide a new and improved shaker apparatus which is susceptible of a low cost of manufacture with regard to both materials and labor, and which accordingly is then susceptible of low prices of sale to the consuming public, thereby making such shaker apparatus economically available to the buying public.

Still yet another object of the present invention is to provide a new and improved shaker apparatus which provides in the apparatuses and methods of the prior art some of the advantages thereof, while simultaneously overcoming some of the disadvantages normally associated therewith.

Still another object of the present invention is to provide an apparatus for agitating a bottle of liquid paper and further usable for shaking a bottle of nail polish.

Lastly, it is an object of the present invention to provide a new and improved a base member that has a front side and a top portion. A bottle holder is provided and has a flat member. The flat member has an interior side with a pair of end plates projecting outwardly. A rocker arm extends from an exterior side of the flat member and is symmetrically spaced from the pair of end plates. A generally cylindrical housing member is included and has a first end mounted to the top side of the base member, a second end edge and an inner support plate. The housing member has a battery compartment. Lastly, a vibrator is seated on the inner support plate of the housing member. The vibrator has an upper side with a pair of support brackets. The support brackets are coupled with the rocker arm of the bottle holder to support the bottle holder above the base member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
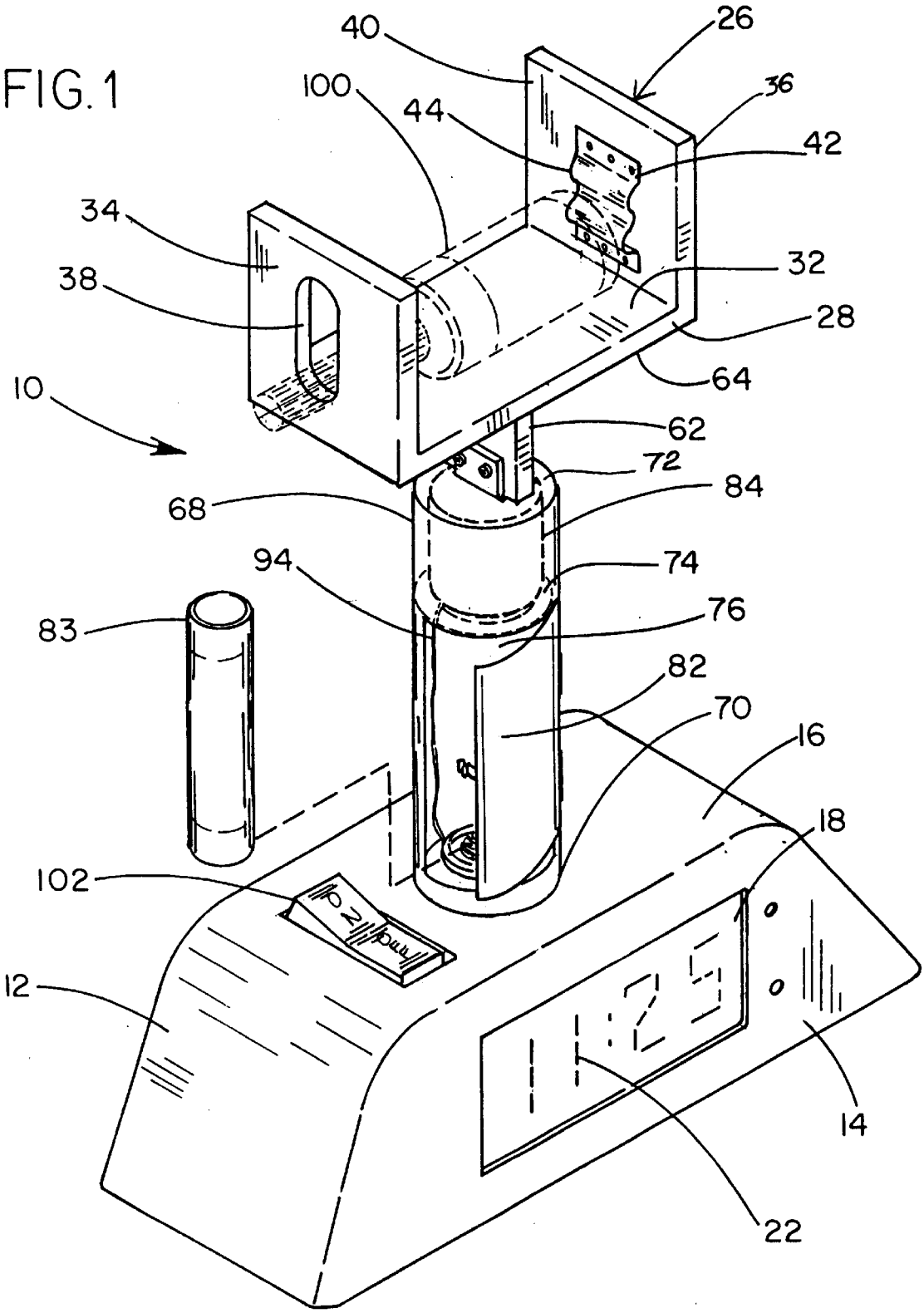
FIG. 1 is a perspective illustration of the preferred embodiment of the shaker apparatus constructed in accordance with the principles of the present invention.

With reference now to the drawings, and in particular to FIG. 1 thereof, a new and improved Shaker apparatus embodying the principles and concepts of the present invention and generally designated by the reference numeral 10 will be described.

The present invention, the new and improved shaker apparatus, is comprised of a plurality of components. Such components in their broadest context include a base member, a bottle holder and a vibrator. Such components are individually configured and correlated with respect to each other so as to attain the desired objective.

More specifically, the present invention includes a generally rectangular base member 12. The base member is formed of a rigid plastic and size to sit on a table or desk top. The base member has a front side 14 and a top portion 16. The base member has an digital time keeping device 18. The digital time keeping device is housed within the base member and has a face 22. The face of the digital time keeping device is displayed on the front side of the base member as seen in FIG. 1. The time keeping device may be any such commercial device or similar device as illustrated, for example, by the patent literature. It may be a clock or a programmable timer to indicate elapsed time or remaining time. It may be coupled to the vibrator motor to terminate vibrations as desired by a user or it may make an audible noise to remind the user that an appropriate time as passed and that the vibrator may be inactivated.

Figure 2:
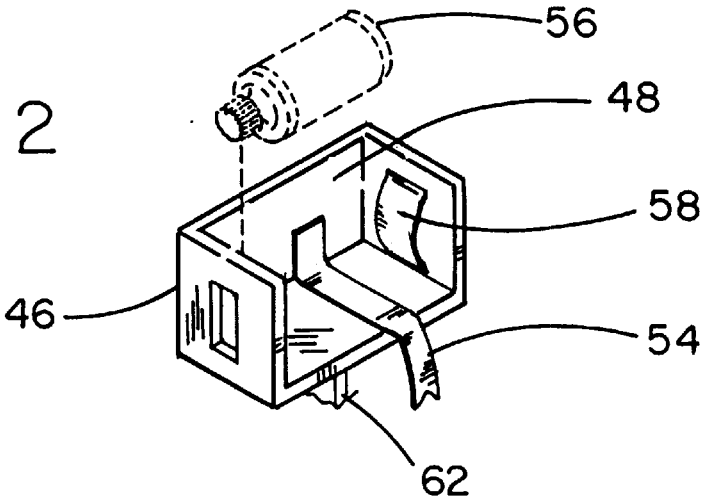
FIG. 2 is a isometric view of the alternative embodiment of the bottle holder.
Figure 3:
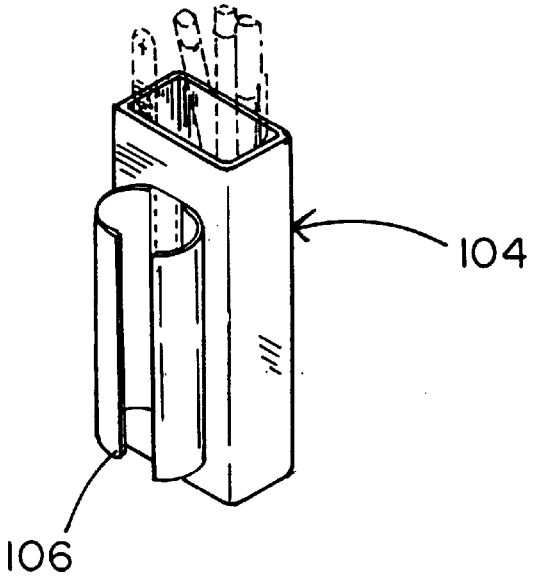
FIG. 3 is an isometric view of the clip on container for holding pencils and pens.

Also, a bottle holder 26 is provided. The bottle holder of FIG. 1 has a flat member 28 with an interior side 32 that has a pair of end plates projecting outwardly. The pair of end plates forming a first end plate 34 and a second end plate 36. The first end plate has an elongated opening 38. The second end plate has an interior face 40 with a tension spring 42 mounted onto the face. As depicted the interior spring, of the bottle holder 26, has ridges 44. FIG. 2 shows an alternative bottle holder embodiment 46 the majority of the bottle holder is identical to the bottle holder of 26. In embodiment 46, a third end plate 48 is provided. This plate encloses the bottle holder 46. Attached to this third end plate is a ribbon 54 to hold a bottle 56 in place. Lastly, the tension spring of the alternative embodiment is a flat spring 58, as seen in FIG. 2. In both embodiments of the bottle the opening of the first end plate is sized to receive the cap of the bottle placed within the bottle holder.

Additionally, a rocker arm 62 extends from an exterior side 64 of the flat member 28. The rocker arm is symmetrically spaced from the pair of end plates.

A generally cylindrical housing member 68 is included. The housing member has a first end 70 mounted to the top side 16 of the base member. The housing member has a second end edge 72 and an inner support plate 74. The housing member has a battery compartment 76. The battery compartment is accessed by way of a hinged door 82. The battery compartment is sized to receive a single AA battery 83.

Figure 4:
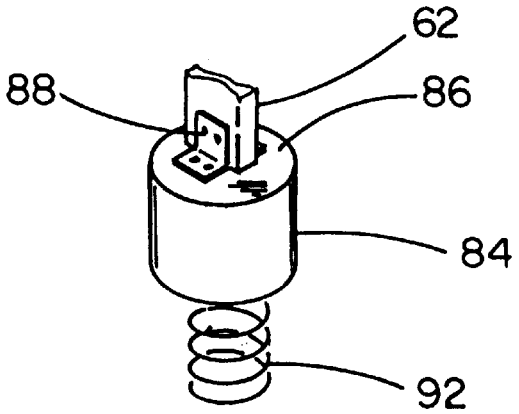
FIG. 4 is a perspective view of the vibrator of FIG. 1.

Lastly, as shown in FIGS. 1 and 4, a vibrator 84 is provided. The vibrator is seated on the inner support plate 74 of the housing member. The vibrator has an upper side 86 with a pair of support brackets 88. The support brackets are coupled with the rocker arm 62 of the bottle holder to support the bottle holder above the base member. The vibrator has a coiled spring 92 seated therein and attached to the inner support plate. The vibrator is in electrical communication with the battery compartment by way of a wire 94. The vibrator moves the rocker arm for shaking a bottle 100 within the bottle holder when activated by a switch 102 positioned on the top side of the base member.

Furthermore, a clip-on accessory 104 is provided. The clip-on accessory is a container that will hold pencils, pens, nail files orange sticks, emery boards and combs for the nail polish end of product. The clip-on retainer has a resilient bracket 106 that may be positioned around the housing member 68.

The present invention shaker apparatus features a rocking motion controlled by a vibrator mounted onto the cylindrical housing member. The vibrator 84 reciprocates the bottle holder 26 up and down with respect to its base member 12 which is longitudinally with respect to the axis of the vibrator. With the bottle holder 26 supporting the bottle 100 on its side and the axis of the bottle perpendicular to the axis of the vibrator, a side to side motion is imparted to the bottle by the vibrator. The bottle holder is made of a hard, molded plastic. The bottle holder is opening on two sides and allows for placement of the bottle of liquid. There is a tension device inside the bottle opening to hold the bottle tightly in position for shaking. This tension device is mounted onto the bottle holder to allow longer handled bottles, such as nail polish containers, to be shaken as well. In another from of the embodiment the bottle holder is closed on three sides and has a ribbon attached to on of the elongated sides of the bottle holder. The bottle holder is attached to a plastic rocker arm that is 2 ¾ high. A small clock and a miniature switch, powered by a AA batteries, are located on the front of the base member.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved shaker apparatus for liquid paper comprising in combination:

a generally rectangular base member having a front side and a top portion, the base member having an digital time keeping device therein with a face of the digital time keeping device being displayed on the front side of the base member;

a bottle holder having a flat member having an interior side with a pair of end plates projecting outwardly therefrom, the pair of end plates forming a first end plate and a second end plate, the first end plate having an elongated opening therethrough, the second end plate having an interior face with a tension spring mounted thereon, a rocker arm extending from an exterior side of the flat member and symmetrically spaced from the pair of end plates;

a generally cylindrical housing member having a first end mounted to the top portion of the base member, a second end edge and an inner support plate, the housing member having a battery compartment; and a vibrator being seated on the inner support plate of the housing member, the vibrator having an upper side with a pair of support brackets, the support brackets being coupled with the rocker arm of the bottle holder to support the bottle holder above the base member, the vibrator being in electrical communication with the battery compartment, the vibrator moving the rocker arm for shaking a bottle within the bottle holder when activated by a switch positioned on the top portion of the base member.

2. A shaker apparatus comprising:

a base member having a front side and a top portion;

a bottle holder with a flat member having an interior side with a pair of end plates projecting outwardly therefrom, a rocker arm extending from an exterior side of the flat member and symmetrically spaced from the pair of end plates;

a generally cylindrical housing member having a first end mounted to the top portion of the base member, a second end edge and an inner support plate, the housing member having a battery compartment; and a vibrator being seated on the inner support plate of the housing member, the vibrator having an upper side with a pair of support brackets, the support brackets being coupled with the rocker arm of the bottle holder to support the bottle holder above the base member.

3. The shaker apparatus as set forth in claim 2, wherein the base member having an digital time keeping device therein, the digital time keeping device having a face being displayed on the front side of the base member.

4. The shaker apparatus as set forth in claim 2, wherein the pair of end plates forming a first end plate and a second end plate.

5. The shaker apparatus as set forth in claim 4, wherein the first end plate having an elongated opening therethrough, and the second end plate having a interior face with a tension spring mounted thereon.

6. The shaker apparatus as set forth in claim 2, wherein the vibrator being in electrical communication with the battery compartment.

7. The shaker apparatus as set forth in claim 6, wherein the vibrator having a coil spring allowing the vibrator to illicit movement from the rocker arm for shaking a bottle within the bottle holder, when activated by a switch positioned on the top portion of the base member.

* * * * *